United States Patent [19]

Giametta

[11] Patent Number: 4,946,203

[45] Date of Patent: Aug. 7, 1990

[54] WASTE PIPE CONNECTOR

[76] Inventor: Joseph A. Giametta, 6912 Cheyenne St., Biloxi, Miss. 39532

[21] Appl. No.: 355,447

[22] Filed: May 22, 1989

[51] Int. Cl.[5] ..... E03C 1/00

[52] U.S. Cl. ..... 285/189; 4/252 R

[58] Field of Search ..... 285/189; 4/252 R

[56] References Cited

U.S. PATENT DOCUMENTS

| | | | |
|---|---|---|---|
| 2,159,021 | 5/1939 | Groeniger | 4/252 R |
| 4,185,334 | 1/1980 | Izzi | 285/58 X |
| 4,355,828 | 10/1982 | Taunton | 4/252 R X |

*Primary Examiner*—Randolph A. Reese
*Assistant Examiner*—Carol I. Bordas

[57] ABSTRACT

A plumbing fitting for coupling a urinal or water closet to the drain waste pipe whether it be copper, PVC, steel or cast iron pipe without using any adapters, threaded pipe or glue. The fitting having a cylindrical body divided longitudinally into two arcuate members having a pipe receiving socket, and a pair of horizontal bars extending perpendicularly from the longitudinal sides of the cylindrical body. The fitting also consists of a protrusion extending from the receiving socket and a flexible gasket positioned on the inside of the cylindrical body having a lip that envelopes the protrusion.

1 Claim, 3 Drawing Sheets

WASTE PIPE CONNECTOR

BACKGROUND OF INVENTION

This invention relates mostly to a plumbing fitting and more particular to an improved connector for connecting urinals and some water closets with internal traps to a drain line.

Connectors for such a purpose are well known in the art and insofar as known, most of which involve the use of a brass threaded flange, adapters and copper fittings. There are many disadvantages by using these methods such as, not having the proper distance of the flange from the finished wall and the possibility of leaks when soldering or tightening threaded joints. Note, soldering would require extra man hours and added most of materials which would be disadvantageous.

There is also another method to install a fixture with an integral trap is with a glue type PVC flange. The disadvantage of this connector is that it can only be used on PVC pipe. Once it is installed it cannot be removed for any reason.

An important object of this present invention is to provide an improved connector of the type described which enables the waste pipe to be cut off after the finished wall is installed with any type of waste lines without any threads, adapters or glue being new to form a seal.

The main object of this invention is to provide an improved connector for connecting a urinal and some water closets with an integral traps to a drain waste pipe which will eliminate the above and other disadvantages of these known connectors.

BACKGROUND ART

Today there are four main types of pipes used in a drain line:

(1). Copper Pipe. To set a urinal using copper pipe, you first have to adapt the copper pipe with a sweat copper female adapter inside the wall and then screw a nipple in it to protrude from the finished wall into the connector. Most of the time if there is not a lot of room in the wall this cannot be done.

(2). PVC Pipe. There is now a connector available for the drain line. The disadvantage being it can only be used on the PVC pipe and once it is used it cannot be taken off.

(3). Steep Pipe. With this method you have to get the correct size nipple to install the connector in order to connect the urinal. There is a lot of times when even an all thread nipple is too long to correctly set a urinal.

(4) Cast Iron Pipe. No connector has not been found for a urinal to fit this type of pipe. To set a water closet on this type of pipe there are some known rubber compression flanges which are quite expensive and hard to install.

SUMMARY

With the prior art urinals and water closet connectors there had to be a groove or a round hole cut around the drain line in order for the outer and extreme end of the connector to enter into the wall. With this new connector this will not have to be done since it fits entirely outside of the wall.

With this connector, one has to simply install the urinal or water closet drain pipe to one half inch past the finished wall, no matter if it be coppe, PVC, steel or cast iron select the correct rubber gasket for a thin wall or regular wall pipe. Simply push the rubber gasket on the drain line. Place each half of the connector around the gasket. Place draw up screws in holes align and tighten. Place bolts through holes of the bolt holder and slide them on the slide bar to the correct measurement for the urinal or water closet to be installed. Since this invention can be used on all types of diameter pipe without using glue, it can be simply dismantled.

This invention has a special feature which will enable the spread of the connecting bolts to be readily adjusted to fit the now presently available urinals with internal traps. It also fits all the available known waste drain lines now being used.

DESCRIPTION OF THE PREFERRED EMBODIMENTS

Figure 1:
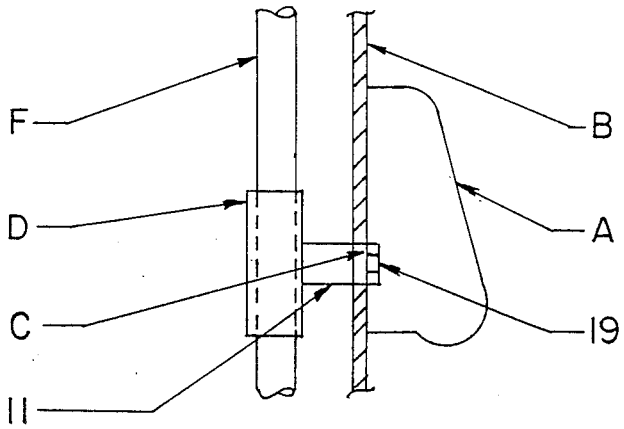
FIG. 1 is a drawing of a wall hung urinal.

FIG. 1 is a drawing of a wall hung urinal (A) hanging on a finished wall. Element (B) denotes the vent and drain pipe (F) with the drain pipe branching off of a tee fitting passing through the wall and into the connector.

Figure 2:
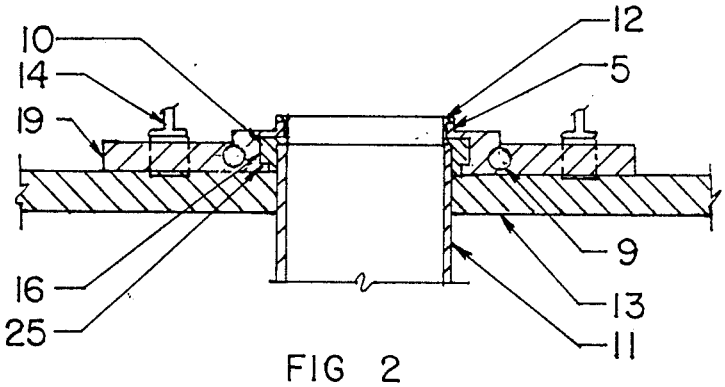
FIG. 2 is a cutaway view of the waste drain connector.

FIG. 2 is a cutaway view of the waste drain connector (C) as it is secured to drain line 11 against the finished wall 13. The rubber gasket 10 is shown around the end of drain 11 past the finished wall 13. The two brass draw up screws 2 are the means for tightening the two piece connector against the third component gasket 10. Element 1 is the bolt holders with bolts 14 in place which slide on each side of the slide bar 19 to accomodate different hole sizing of the fixture to be connected (see FIG. 4). Element 16 indicates the extreme inside of the connector. Element 25 is a holder ring molded into the wall side of the connector 360 degrees. Element 12 is part of gasket 10 enveloping the inside of the connector over ring 5. Element 9 is a countersunk hole in upper half split connector 22. The connector fits with its extremeties against the finished wall 13.

Figure 3:
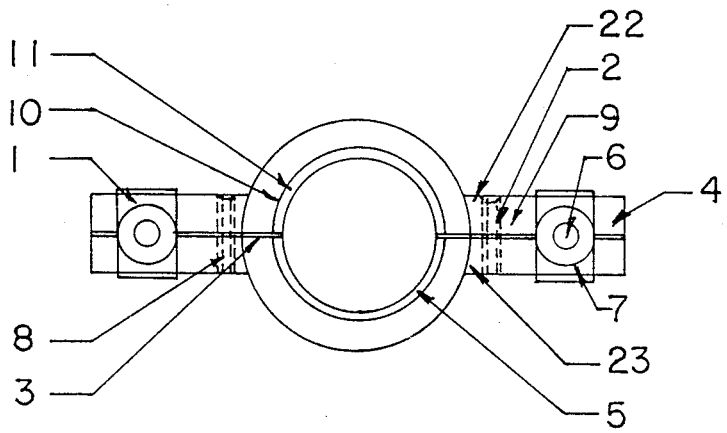
FIG. 3 is a front view of the connector.

FIG. 3 shows the connector from the front view. It is noted that the connector is split horizontally in two halves. The top half being element 22 and the bottom half being element 23. The top half 22 having countersunk screw holes which align with tapped holes 8 in lower half 23 of the connector. Element 2 is two brass Phillips head screws which can be tightened from the top of the connector outside of the finished wall 13. Element 3 indicates the horizontal split connector. Element 5 is a raised ring to hold gasket 10 in FIG. 7. Element 4 is the front part of the slide bar 19. The bolt holder 1 holds the bolt 14 centered in the hole 6 and conforms to fit a closet bolt head 15, as illustrated in FIG. 4.

Figure 4:
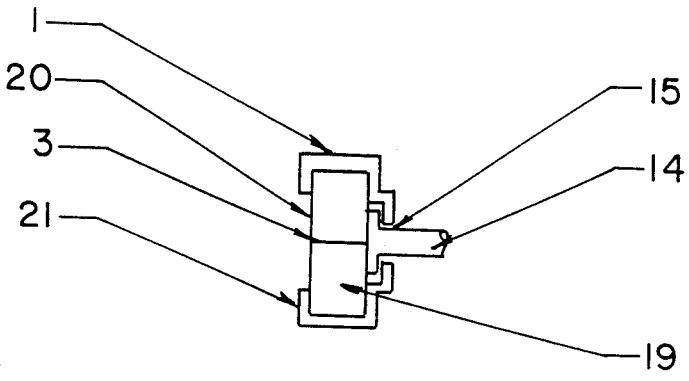
FIG. 4 shows the bolt holder from one side of the connector.

FIG. 4 shows the bolt holder 1 as it looks from one end of the connector. When the two piece connector is drawn tight the bolt holders will slide on the slide bar 19. There is a hole 6 in the front center of the holder 1 with a molded slot to hold the head of the closet bolt in place. The bolt 14 has to be pushed into the holder and then slid on the slide bar 19. Element 21 is the holder return end. Element 20 is the back of the slide bar 19.

Figure 5:
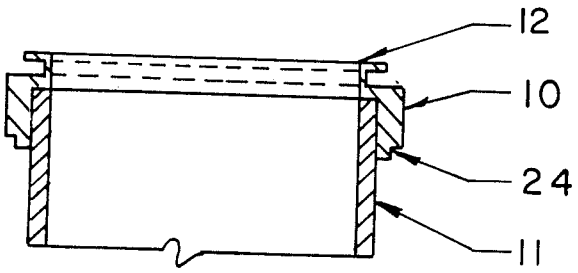
FIG. 5 is a cutaway view of the rubber gasket.

FIG. 5 is a cutaway view of the rubber gasket 10 that is pulled over the drain line 11. Element 24 is a slot around the outside edge or wall side of the connector which when combined with the inside ring holder 25 in FIG. 2 and when the two halves of the connector are pulled down locks the device together. The rubber gasket 10 fits firmly against the outside of the drain line 11 and its outer extremeties being larger than the inside of the two part connector therefore, a seal is formed when the two pieces are drawn together. Element 12 is a part of gasket 10 which envelopes the inside part of the connector and the gasket holder 5. Since the outside of pipes have different circumferences, one rubber gasket has to be manufactured for thin wall pipes and another for regular wall pipes with the outside connector being able to interchange with either pipe.

Figure 6:
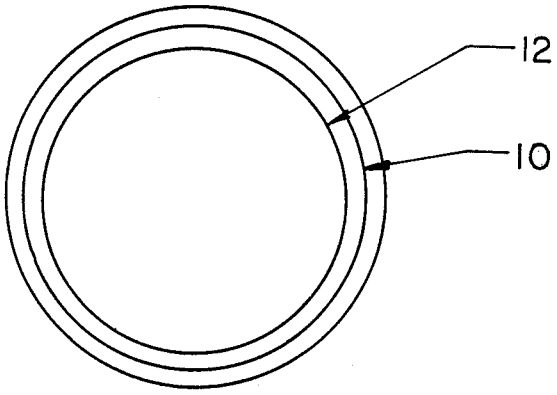
FIG. 6 is a elevation view of the round rubber gasket.

FIG. 6 is an elevation view of the round rubber gasket 10 showing the inside wrap around edge of element 12.

Figure 7:
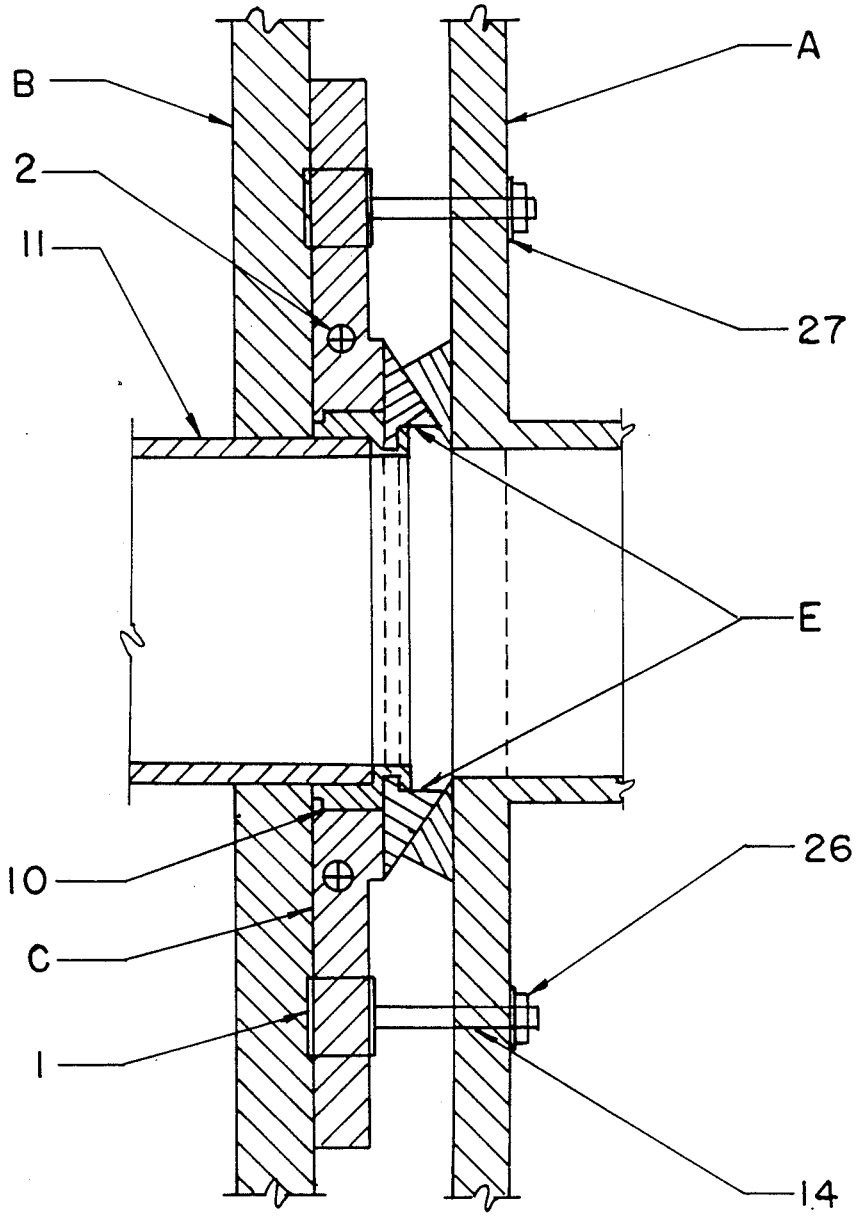
FIG. 7 is a cutaway view of the connector with the urinal being installed.

FIG. 7 is a cutaway view of the connector in place, fitting on drain line 11 against the wall (B) with fixture (A) pulled up against the wall by bolts 14 in bolt holder 1 with washer 27 and nut 26 compressing gasket 10 to form a water tight seal. In order to set this fixture, bolt holder 1 has to be slid on the bars to accommodate the holes in the fixture.

It is to be understood, that the form of my invention herewith shown and described is to be taken as a preferred example of the same and that various changes in the shape, size and arrangements of parts may be resorted to without departure of the spirit of the invention or the scope of the subjoined claims.

I claim:

1. A waste pipe connector for mounting a fixture with an intergral trap, such as a urinal to a drain pipe which extends through a wall comprising:

a cylindrical body divided longitudinally into two arcuate members having a pipe receiving socket, a pair of horizontal bars extending perpendicularly from the longitudinal sides of the cylindrical body, and a protrusion extending from the receiving socket;

a flexible gasket positioned on the inside of the cylindrical body having a lip that envelopes the protrusion;

said receiving socket having an opening smaller than the outside diameter of the gasket and including means for engaging and locking the gasket;

said pair of horizontal bars are positioned such that each pair of horizontal bars extend in a side-by-side relationship and where there is a screw hole in one of the horizontal bars of the pair of horizontal bars and a tapped hole in alignment with the screw hole in the other bar of the horizontal bars so that draw screws can be placed in the screw and tapped holes and used to secure the two bars together;

said arcuate members are positioned around the gasket which receives the drain pipe and wherein this arrangement is secured via the draw screws which when tightened in the screw holes pull the arcuate members around the gasket and results in a seal;

and wherein the bars have metal bolt holders which receive and hold a closet bolt which is able to slide on the bar to secure many different sizes of fixtures.

* * * * *

UNITED STATES PATENT AND TRADEMARK OFFICE

CERTIFICATE OF CORRECTION

PATENT NO. : 4,946,203

DATED : Aug. 7. 1990

INVENTOR(S) : Joseph A. Giametta

It is certified that error appears in the above-identified patent and that said Letters Patent is hereby corrected as shown below:

Column 1, line 27, delete "new" and insert --used--.

line 48, delete "Steep" and insert -- Steel--.

line 52, delete "not"

line 67, delete "coppe" and insert --copper--.

Signed and Sealed this

Tenth Day of September, 1991

*Attest:*

*Attesting Officer*

HARRY F. MANBECK, JR.

*Commissioner of Patents and Trademarks*